United States Patent [19]

Zauderer

[11] Patent Number: 4,765,258

[45] Date of Patent: Aug. 23, 1988

[54] METHOD OF OPTIMIZING COMBUSTION AND THE CAPTURE OF POLLUTANTS DURING COAL COMBUSTION IN A CYCLONE COMBUSTOR

[75] Inventor: Bert Zauderer, Merion, Pa.

[73] Assignee: Coal Tech Corp., Merion, Pa.

[21] Appl. No.: 834,143

[22] Filed: Feb. 26, 1986

Related U.S. Application Data

[63] Continuation of Ser. No. 612,739, May 21, 1984, abandoned.

[51] Int. Cl.[4] ..... F23D 1/02

[52] U.S. Cl. ..... 110/347; 110/245; 110/264; 110/266

[58] Field of Search ..... 110/245, 347, 260–265; 432/210

[56] References Cited

U.S. PATENT DOCUMENTS

| | | | |
|---|---|---|---|
| 2,738,776 | 3/1956 | Burg | 110/261 |
| 2,979,000 | 4/1961 | Sifin | 110/265 |
| 3,179,074 | 4/1965 | Clark et al. | 110/265 |
| 3,199,476 | 8/1965 | Nettel | 110/265 |
| 3,250,236 | 5/1966 | Zelinski | 110/265 |
| 4,102,277 | 7/1978 | Wall | 110/245 |
| 4,147,116 | 4/1979 | Graybill | 110/264 |
| 4,217,132 | 8/1980 | Burge et al. | 75/26 |
| 4,259,911 | 4/1981 | Jones | 110/263 |
| 4,325,327 | 4/1982 | Kantesaria et al. | 110/245 |
| 4,331,638 | 5/1982 | Michelfelder | 423/210 |
| 4,333,405 | 6/1982 | Michelfelder et al. | 110/265 |
| 4,381,718 | 5/1983 | Carver et al. | 110/347 |
| 4,395,975 | 8/1983 | Ashworth et al. | 122/5 |
| 4,423,782 | 1/1984 | Ashworth et al. | 122/5 |
| 4,435,148 | 3/1984 | Moss | 122/4 D |
| 4,517,165 | 5/1985 | Moriarty | 423/244 |
| 4,523,522 | 6/1985 | Moriarty et al. | 110/347 |
| 4,586,443 | 5/1986 | Burge et al. | 110/347 |
| 4,624,191 | 11/1986 | Zauderer et al. | 110/266 |
| 4,685,404 | 8/1987 | Sheppard et al. | 110/266 |

*Primary Examiner*—Henry C. Yuen

*Attorney, Agent, or Firm*—Robert C. Podwil

[57] ABSTRACT

Coal combustion and the capture of pollutants are optimized by a method which applies two mechanisms for sulphur capture, one in which pulverized coal particles suspended in the gas stream in the injection zone of the combustor are affected by reaction with a suspended sorbent, and another in which the particles are reentrained in the gas stream by a "sand storm" effect near the wall of the combustor. Use of the two mechanisms results, in commercial scale cyclone combustors, in 70 to 90% sulphur capture at economical Ca/S ratios. The method also minimizes emission of ash by removal from the pulverized coal fuel particles too small to be retained in the combustor and too large to be completely burned in the combustor, minimizes reevolution of sulphur compounds from slag by rapid and continuous removal of slag from the combustor, minimizes emission of $NO_x$ pollutants by maintaining a favorable overall fuel-rich stoichiometry.

14 Claims, 4 Drawing Sheets

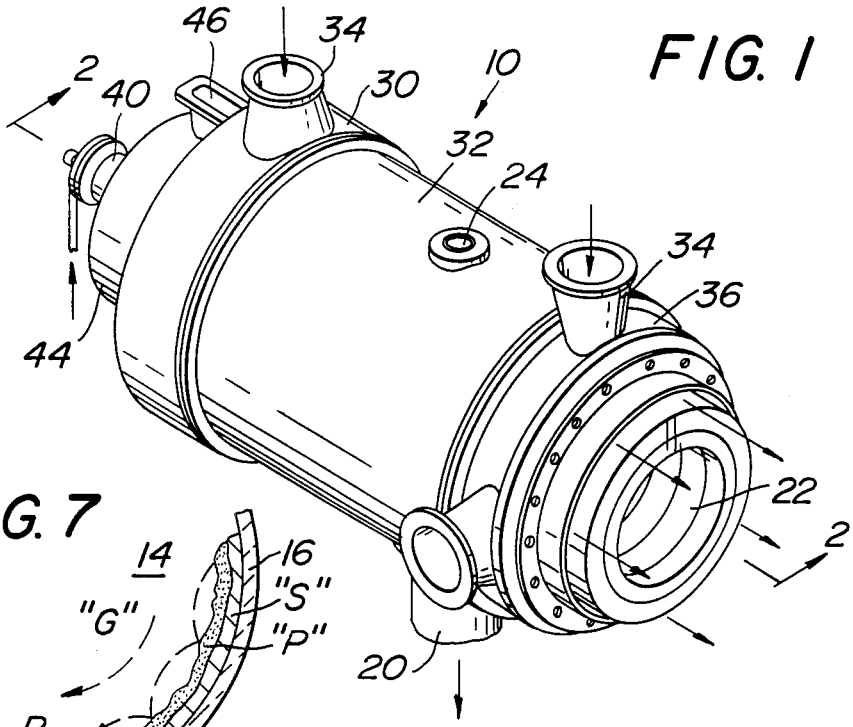
FIG. 1
FIG. 7
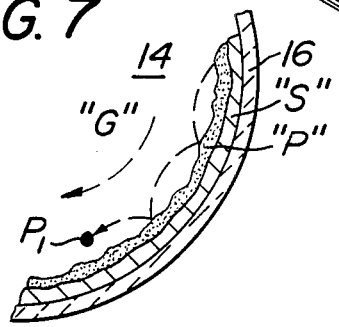
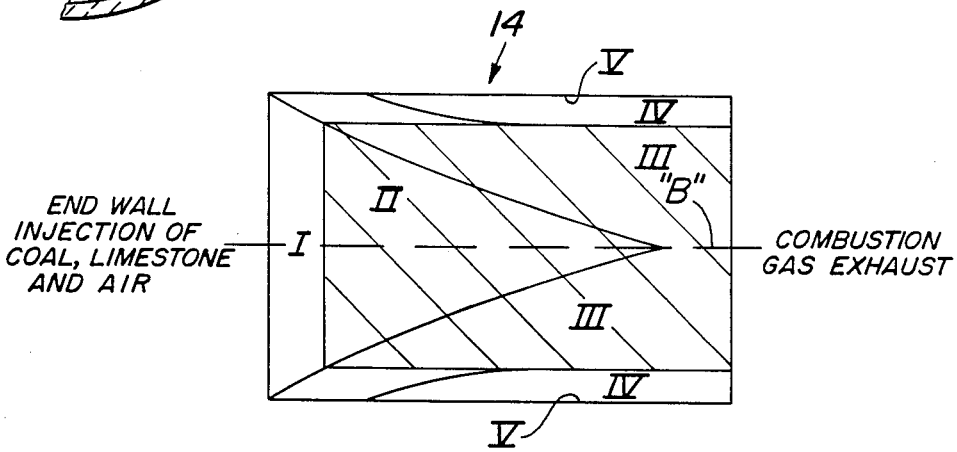
FIG. 5

FIG. 3
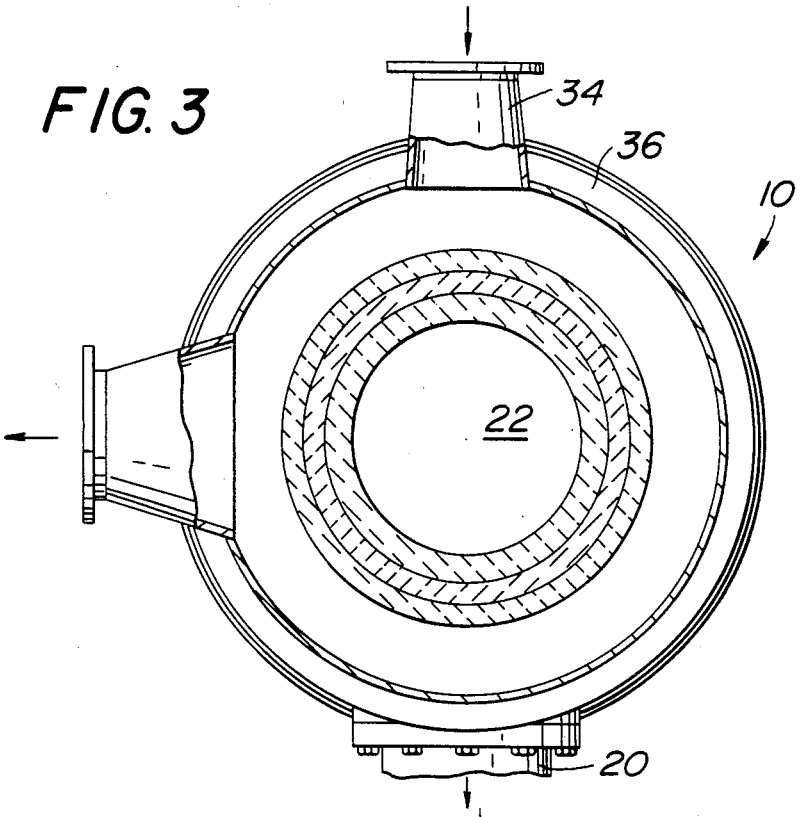
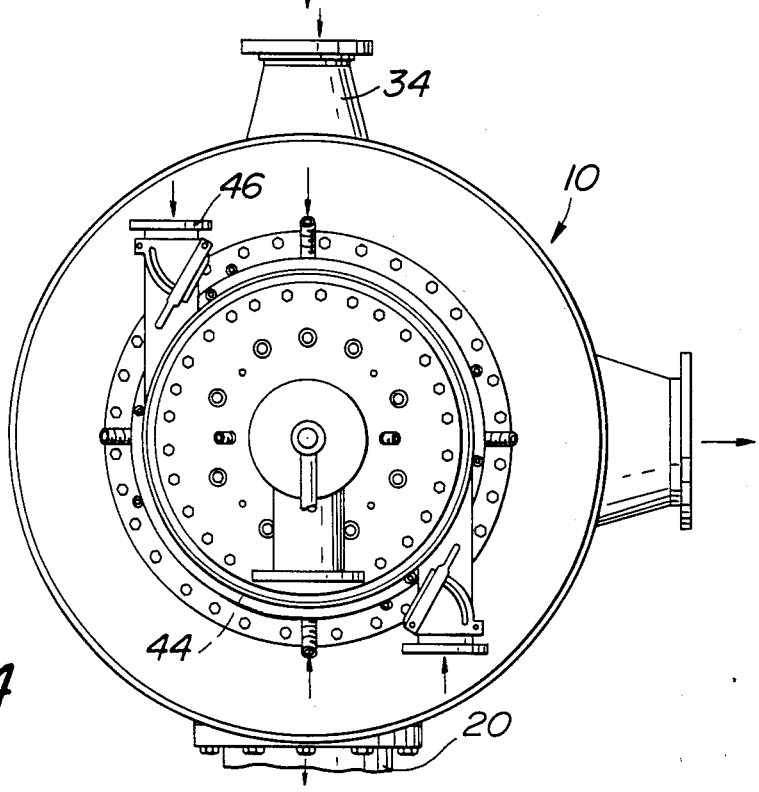
FIG. 4

METHOD OF OPTIMIZING COMBUSTION AND THE CAPTURE OF POLLUTANTS DURING COAL COMBUSTION IN A CYCLONE COMBUSTOR

The U.S. Government has a paid-up license in this invention and the right in limited circumstances to require the patent owner to license others on reasonable terms as provided for by the terms of contract No. DE-AC22-82PC50050 and grant No. CPE-8260265.

This application is a continuation of Ser. No. 06/612,739 filed May 21, 1984, now abandoned.

BACKGROUND OF THE INVENTION

This invention relates to a method for the combustion of coal in a cyclone combustor, and more particularly, to a method which minimizes the emission of ash particles and other pollutants from such a combustor.

The apparatus known as a cyclone coal combustor consists of a cylindrical chamber into which pulverized coal is injected and centrifuged to the cylindrical wall of the chamber by a high velocity, swirling gas flow. Heretofore, most cyclone combustors have been designed for combustion to take place near or at the cylindrical wall, and at a temperature sufficiently high, on the order of about 3000° F., to melt the coal ash. Conventionally, the melted coal ash, or slag, has been drained continuously from the combustor. Although there are two general types of cyclone combustors, the horizontal cyclone of interest in connection with the present application and the reverse flow vertical cyclone, most prior commercial experience is with the horizontal cyclone.

Commercial horizontal cyclone combustors heretofore used have removed from 70 to 85 percent of coal ash as slag. These commercial cyclone combustors, typically of 100 to 700 million BTU/per hour capacity, were used extensively in large utility and industrial boilers in the 1950's and early 1960's. Their inability however, to control the emission of $NO_x$, led to the discontinuance of their use in the late 1960's, as environmental concerns grew. Renewed interest arose in the cyclone combustor in the mid 1970's due to the need for a low ash output combustor in conjunction with the U.S. Department of Energy's magnetohydrodynamics ("MHD") program. This work, as well as greatly expanded research and development efforts on coal combustion phenomena, led to an improved understanding of the cyclone combustor (C. S. Cook, et al., "Evaluation of Closed Cycle MHD Power", DOE Contract Report No. DE-AC01--78ET 10818, Nov., 1981) ("Ref. 1").

A one million BTU/hr. air cooled, horizontal cyclone coal combustor, which was tested as part of an MHD program activity, had a central oil gun located at the center of the closed end of the unit. The oil gun was used to preheat the combustor wall, which was ceramic lined, and to start coal combustion. Pulverized coal, in this combustor, was transported by a primary air stream in about a one-to-one air/coal mass ratio, and injected into the combustor in an annular region surrounding the oil gun. The ceramic liner was maintained at a temperature of about 2200° to 2500° F., a temperature high enough to keep the coal slag in a liquid free flowing state. The ceramic liner was cooled by an air stream which was also used as the secondary air stream. The cooling/secondary air stream was injected at the closed end of the combustor to produce the characteristic swirling gas motion around the axis of the combustor, and the injection velocity was high enough to obtain tangential gas velocities of several hundred feet per second at the cylindrical walls of the combustor. In the above-described apparatus, efforts were made to burn as much of the coal particles as possible in suspension near the cylindrical wall of the combustor, and the unit was operated with conventional pulverized coal, having a conventional particle size distribution. Nevertheless, the above-described prior art device achieved slag retention values in excess of 80 percent and, in some cases, when operated with a somewhat more coarse coal particle size distribution (70% through 200 mesh), slag retention above 90 percent was evident. Significant $NO_x$ emission reductions were obtained with this apparatus and method by operating it at sub-stoichiometric conditions in the range of 60–90% of the stoichiometric air/fuel ratio (Ref. 1). In addition, pulverized limestone was injected as a sorbent directly through the closed end of the combustor, and this resulted in 25 to 35 percent reductions in the $SO_2$ emissions from the combustor. The reacted sorbent was embedded in the slag and removed with it through a slag tap located at the down stream end of the combustor.

Horizontal cyclone combustors which were in commercial use in the United States and Germany in the 1950's and '60's had the primary air (which carried the coal) and the secondary air (which produced the swirl) injected tangentially along most of the top axial length of the unit. (Babcock & Wilcox Co., *STEAM*, ch. 10 (1978 ed.) ("Ref. 2")). The U.S. units typically operated with coarse crushed coal (50 percent through 20 to 40 mesh), in order to conserve pulverization power and to provide a method for burning coals having low ash fusion temperatures. Due, however, to the use of such very large coal particles, it was assumed that most of the coal combustion process took place on the surface of the slag, so that excess air, scrubbing the slag layer, was necessary for complete combustion. This, of course, produced high $NO_x$ emissions, and ultimately led to discontinuance of the use of such combustors.

The German commercial horizontal cyclone coal combustors were similar in design to the above-described U.S. units. (H Seidl, "Development & Practice of Cyclone Firing in Germany", *Proc. Jt. Conf. on Combustion* ASME-I.Mech.Eng., MIT, Cambridge, Mass., June, 1955, p. 92) ("Ref. 3"). However, in the German case, the intended application was the combustion of very high ash (up to 40 percent) coal which had low volatile matter content (under 20 percent). Consequently, a finer, but still relatively coarse pulverized coal particle distribution (approximately 60 percent through 100 mesh, i.e., 150 micron diameter coal particles) was used. These units obtained up to 85 percent slag retention, as compared to only 70 percent in the U.S. units.

Another class of cyclone combustors is the vertical, reverse flow type, whose design principles are very similar to those of conventional cyclone dust separators. A detailed experimental study of such a device was performed by Hoy (H. R. Hoy, et al., "Some Investigations with a Small Cyclone Combustor" in *Jrn. Inst. Fuel*, Oct., 1958, p. 429) ("Ref. 4"). In the unit studied by Hoy, which had a relatively large 20 million BTU/per hr. coal energy throughout, 80 to 85% of the slag was retained in the combustor. It was observed, however, that the reverse flow had a tendency to reentrain slag from the walls in some cases.

One observation of importance in relation to the present invention should be made here in connection with the above-described cyclone combustors and other cyclone combustors being developed for MHD applications. In this regard, it is of significance that in these units coal was injected very close to the hot, liquid slag-covered walls, and as a result, the coal particles impinged very rapidly on the slag-covered walls. Thus, in such units, even the smaller particles that remained in suspension in the gas stream for but brief periods were in a gas temperature environment in the 3000° F. range. Under these conditions, convective heating of the particles results in rapid pyrolysis and devolatilization of the coal particles. In the cyclone combustors developed for MHD applications, discussed below, in which different coal injection techniques were used, the use of very high temperature air preheat (in the 2000° to 3000° F. range) produces a similar effect. By contrast, in the air-cooled cyclone combustor of the present invention, coal injection occurs in a relatively cold gas environment, and therefore, considerably longer time periods are required and employed for coal pyrolysis.

The MHD program gave rise to a need for a high slag retention combustor. Several investigators designed and tested different versions of cyclone combustors intended for the MHD application. The Pittsburgh Energy Technology Center designed and tested a vertical unit similar in concept to Hoy's device. (W. S. Lewellen, et al., "Modeling Two Phase Flow in a Swirl Combustor", Aeronautical Research Rpt., (00-4062-5 (1977)) Princenton, N.J.) ("Ref. 5"). TRW designed a horizontal unit, similar to the early United States and German units described above. (J. A. Hardgrove, "MHD Cost Fired Combustor Dev.", *9th Energy Tech. Conf. Proc.*, Wash., D.C. Feb., 1982) ("Ref. 6"). The TRW unit, however, differed in that it used axial coal injection, as distinguished from the tangential injection used in the commercial units.

One significant operational difference between the processes performed by the cyclone combustors intended for the MHD application and the U.S. and German commercial units is the extremely rapid devolatilization that occurs in the MHD units due to the very high temperature air preheat which is used. This condition, coupled with the general use of relatively fine coal particle size distributions in such units appears to have resulted in the MHD units not only in rapid devolatilization, but also very rapid char gasification of much of the fuel while the coal particles were in suspension in the gas stream. These conditions account for very high carbon conversion, but low slag retention (in some cases as low as 30 percent) (Ref. 6).

Another prior art technique for the control of certain emissions in the combustion of coal is the injection into combustion chambers and furnaces of limestone or similar calcium oxide compounds as sorbents or binders for sulphur compounds. In the case of the million BTU/hr. combustor described above, 25 to 35 percent reductions in $SO_2$ emissions were observed with the injection of pulverized limestone, and the reaction products of the limestone were removed with the coal slag. No explanation for this capture process was given (Ref. 1). Generally, the physical states of the sulphur capture process using calcium oxide compounds is by now well understood. The first step in the process is calcination, wherein $CaCO_3$ is converted to CaO by removal of $CO_2$ from the $CaCO_3$ particle. A porous structure is left after calcination. With excess oxygen, sulphur capture leads to the formation of $CaSO_4$. Under equilibrium conditions, this compound moves toward dissociation above about 2000° F. Sulfation takes place heterogeneously by $SO_x$ contact with CaO, and it is affected by $SO_x$ diffusion through the CaO pore structure. Eventually, however, a layer of $CaSO_4$ encapsulates the particle and stops the reaction.

For cyclone combustor applications, the average gas temperature is 3000° F., which is much too high for equilibrium sulphur capture. However, it is now hypothesized in accordance with this invention that sulphur capture takes place during the time in which the $CaCO_3$ particle is suspended in the combustion gases, the time for sulphur capture is in the 100 milliseconds time range.

Still another mechanism by which pollutants are removed from cyclone combustors utilizes the slag layer. The slag removes the mineral matter from the coal in liquid form, and serves as well as a base upon which one can burn up the remaining particles of char in the coal which floats on the slag and to remove the calcium-sulphur compounds resulting from the limestone injection. One problem, however, with prior art techniques has been the reevolution of $SO_2$ from the slag layer. This occurs because at the temperatures of the slag layer, approximately 2200° to 2500° F., calcium sulphate in the slag will melt and react with species in the slag such as iron compounds or gases above the slag layer such as $0_2$ or $CO_2$. For partial pressures of oxygen of less than 0.1 atmospheres, a condition likely to exist in a cyclone combustor, the rate of $SO_2$, evolution from slag is in the time range of 15 to 20 minutes. It is, therefore, essential to remove the slag in a time less than this to avoid reevolution of sulphur. Reevolution is retarded somewhat, it has been found, by maintaining local reducing conditions above the slag. However, as noted, compounds such as those of iron can catalyze the reaction which converts chemically bound sulphur in the slag to gaseous form.

BRIEF DESCRIPTION OF THE INVENTION

It is a general object of this invention to provide a method in which various streams of coal, limestone (or other calcium oxide compounds) and air are injected into a cyclone combustor, and the gaseous, liquid and solid combustion products are removed from the cyclone so as to (1) optimize the combustion of the volatile and carbon compounds in the coal; (2) maximize the capture of the gaseous compounds of sulphur in the combustion gases inside the combustor by reacting them with particles of calcium oxide compounds; and (3) remove the reacted calcium oxide-sulphur compounds with the liquified coal ash prior to their entry into the exhaust gas stream of the combustor. Accordingly, it is an object of this invention to maximize the removal of solid and liquid particles prior to their entrainment in the combustion gas exhaust. It is still another object to this invention to provide a method which also allows for maximum reduction in the gaseous nitrogen compounds in the exhaust of any heat absorbing furnace to which the combustor may be attached. All these functions are performed, in accordance with the invention, under conditions which result in the maximum coal throughout per unit volume of combustor.

The foregoing and other objects are realized, in a presently preferred form of the invention, by a method which comprises, in one of its aspects, the steps of pulverizing coal and removing from the pulverized coal particles smaller than about 10–20 microns and larger than about 200 microns in diameter; injecting the remaining pulverized coal into a cyclone combustor together with a stream of primary combustion air; and injecting into the combustor a stream of secondary air in such a manner as to cause the secondary air flow helically within the combustor and to surround the air-fuel stream and to have a maximum tangential velocity at the wall of the combustor of between 100 ft. per second and 300 ft. per second. Such a technique, it has been found, minimizes the emission of ash particles from the combustor. The smaller than 10–20 micron particles will be injected at the closed end of the combustor, near the cylindrical slag-covered wall, as an aid to rapid ignition of the coal.

In another aspect of the invention, the emission of sulphur compounds is minimized by injecting into the combustor, in an air stream adjacent to the air-fuel stream, a pulverized sorbent comprising a calcium oxide compound. In accordance with the invention, injection of the air-fuel stream, the secondary air stream and the sorbent takes place through a closed end wall of the combustor, and into a region which has a local gas temperature lower than the average gas temperature in the combustor, so as to preserve the efficacy of the sorbent. Local gas conditions in the above-mentioned region are oxidizing, so as to enhance devolatilization and char burn-up of coal particles, but the combustor is operated at an overall fuel-rich condition so as to achieve a reduction of gaseous nitrogen compounds in the exhaust stream, enhance the retention of captured sulphur and to minimize the size of the combustor by reducing the gas flow it must accommodate.

In general, then, the present invention relates to processes in which two separate sulphur capture mechanisms are employed. The first of these is as a result of rapid thermal calcination of the particles of limestone or other calcium oxide compounds suspended in the gas flow. This, it has been found, produces a very porous particle having a far higher sulphur capture rate than exists in a packed bed. The other capture mechanism results from the reentrainment of limestone particles deposited on the slag covered wall of the combustor by high velocity swirling gas flow, in a manner similar to the entrainment of sand in a desert storm. Each mechanism acts independently of the other, and their actions combine to minimize sulphur emissions. Ash emissions are minimized, in accordance with the invention, by directing the ash to the slag, which is rapidly removed from the combustor, and $NO_x$ pollutants are minimized by maintaining in the combustor an average stoichiometry which is reducing, in the range of 50–70% of stoichiometric air/fuel ratio.

For the purpose of illustrating the invention, there is shown in the drawing a form of combustor in which the present process may be practiced, it being understood, however, that the invention is not limited to the precise arrangements and instrumentalities shown.

BRIEF DESCRIPTION OF THE DRAWINGS

FIG. 1 is a perspective view of a cyclone combustor in which the invention may be practiced.

FIG. 3 is a cross-sectional view, taken along the line 3—3 in FIG. 2.

FIG. 4 is an end view of the apparatus shown in FIGS. 1 and 2.

FIG. 5 is a diagrammatic cross-sectional view of the interior of a cyclone coal combustor in which the present method is practiced, showing various combustion regions within the combustor.

FIG. 7 is a diagrammatic partial cross-sectional view of a combustor, depicting the characteristic "sandstorm" effect achieved in accordance with the invention.

DETAILED DESCRIPTION

Figure 2:
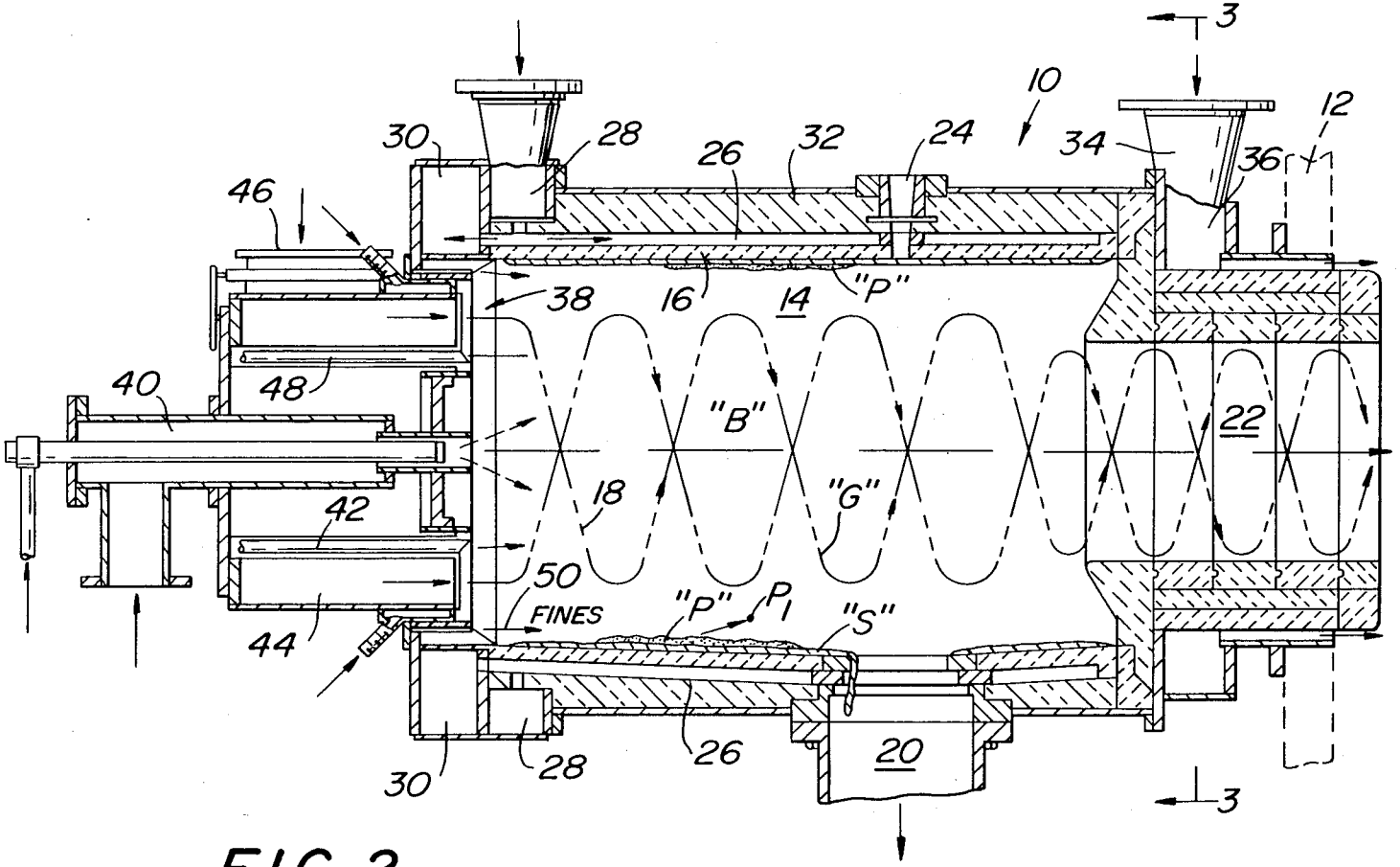
FIG. 2 is a cross-sectional view, taken along the line 2—2 in FIG. 1.
Figure 6:
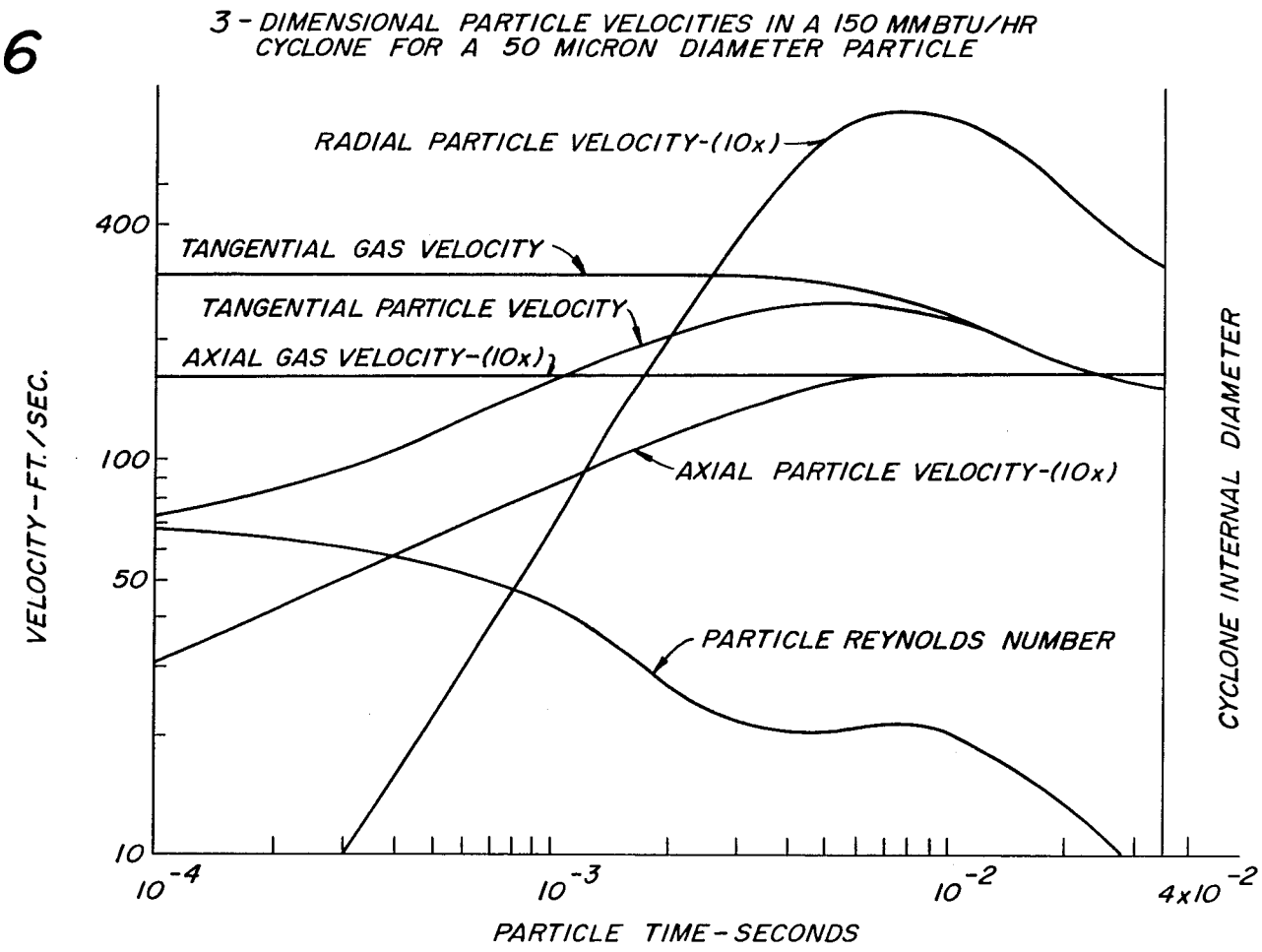
FIG. 6 is a graphic depiction of the three-dimensional velocities of a 50 micron diameter particle in a 150 million BTU/hr. cyclone combustor.

Referring now to the drawings in detail, wherein like reference numerals indicate like elements, there is seen in FIGS. 1 through 4 a form of cyclone coal combustor ("combustor"), designated generally by the reference numeral 10, in which the present method may be practiced.

The combustor 10 may be attached directly to the face of a boiler furnace box, a wall 12 of which is seen in phantom in FIG. 2.

The combustor 10 includes a cylindrical chamber 14, coated with a non-sacrificial ceramic lining 16. The chamber 14 provides an enclosure in which helical gas flow, depicted by the dotted lines 18, can be established in accordance with principles of this invention.

In communication with the chamber 14 is a slag tap 20, through which liquid slag may flow for removal, and an outlet port 22, through which combustion products may pass from the chamber 14 to the boiler furnace box. A view and diagnostic port 24 allows for observation of conditions within the chamber 14.

Air cooling passages, of which the passage 26 is exemplary, extend axially with respect to the chamber 14, and are disposed at radially spaced locations around the outer periphery of the chamber 14. A plenum, or manifold 28, which is in fluid communication with the passages 26, supplies cooling air to the passages 26. The passages 26 are so configured as to communicate, too, with a plenum, or manifold 30, from which the cooling air may be withdrawn. The air cooling passages are surrounded by an insulating medium 32.

An inlet 34 communicates with a plenum, or manifold 36, which provides cooling air for the outlet port 22, as well as additional air (tertiary, it will be seen) for the boiler.

An aspect of the present process involves the introduction of a fuel-air stream, a stream of secondary air, and a sorbent for sulfur at an end wall of the combustor 10, best seen in FIG. 2 and designated generally by the reference numeral 38.

Associated with the end wall 38 is an axially mounted oil burner 40, whose function it is to preheat the combustor 10 for start-up and to provide initial ignition of the pulverized coal fuel.

Disposed around the oil burner 40 in a circular array and pointed in an axial direction are outlets 42, through which a mixture of fuel and primary air may be introduced into the chamber 14. Disposed radially outwardly with respect to the outlets 42 is a chamber 44 into which secondary air may be introduced through an intake 46. Secondary air emerging from the chamber 44 takes on the helical flow depicted symbolically by the arrows 18 in FIG. 2.

Also disposed in a circular array in the end wall 38, and spaced from the central axis of the combustor 10 about equally as far as the outlets 42, are outlets 48, through which a sorbent may be injected into the chamber 14. The outlets 42 and 48, therefore, inject the fuel-air mixture and the sorbent radially inwardly of the moving body of secondary air symbolized by the arrows 18.

Coal fines (particles having diameters of under about 20 microns) may also be introduced to the chamber 14 through the end wall 38, by means of radially spaced, axially directed nozzles 50.

The fuel-air stream preferably has a temperature of about 160° F. The secondary air stream is preferably preheated to between about 1000° F. and 1300° F. High secondary air temperatures assure rapid ignition of coal particles.

A method of optimizing combustion and the capture of pollutants during coal combustion, making use of apparatus of the above kind, will now be described.

FIG. 5 illustrates a model which describes the different combustion zones or regions inside the chamber 14 of a combustor 10. The five zones shown in FIG. 5 apply to the analysis of a one foot diameter 1,000,000 BTU/hr. combustor, but with some modifications, which are described below, the same model can aptly describe a commercial scale 6.75 foot diameter, 10 foot long, 150,000,000 BTU/hr. combustor.

The coal, primary air and secondary air are injected symmetrically around the axis of the chamber 14, at the closed end of the chamber 14 corresponding to the above-described wall 38. Such injection takes place in Zone I, along with pyrolysis of the coal. In the commercial scale combustor, relatively fine (less than 44 micron diameter) coal particles are heated and completely devolatilized in this zone, while the remaining char is gasified in the other zones of the cyclone by the combined effect of the secondary air at approximately 1,000° F., radiation from the slag covered walls of the chamber 14 at approximately 2,000° F., and recirculated hot combustion gases from the other zones. Zone III represents the turbulent gas boundary layer, which, due to the 1/7th power law dependence of the boundary layer, influences coal particle heating and ignition only in a region very close to the wall of the chamber 14. Zone V is the wall burning zone for coal, char or limestone particles lying in physical contact with the slag layer. Zone IV is the reentrainment zone, to be described in detail below, where much of the combustion and sulphur capture with limestone takes place in a region within several centimeters of the wall Zone II, which encompasses parts of Zones I and III, is the region in which turbulent mixing occurs of the products of combustion released from the volatiles and char in Zones I, IV and V.

Although, in general, the model of FIG. 5 could be used to describe the commercial combustor, for such a combustor the model should in fact be modified in that in Zone I coal particles are heated to devolatization; in the initial part of Zone II combustion of the volatiles released in Zone I and the initial part of Zone II takes place; and Zone III is much smaller and nearer the wall of the chamber 14 than in the former case. Zones IV and V are also far smaller than before.

Coal Combustion With Maximum Particle Retention and $NO_x$ Control

It is known that after a coal particle in suspension in a gas stream has burned sufficiently to reduce its mass by 50 to 70%, it tends to disintegrate into smaller particles, from which embedded ash particles are easily released. It is also known that particles below the range of 10 to 20 microns in diameter are extremely difficult to retain in a cyclone combustor. Such particles tend to escape as pollutants unless they randomly impinge upon and are embedded in the liquid slag layer which typically covers the combustor's inner wall. Thus, in accordance with the present invention, complete combustion of coal particles in flight is not sought. Rather, a major fraction (about 70%) of coal particles within a properly selected size distribution are made to burn in gas suspension, and the last 30 to 50% of coal particle burn-up be made to occur on the slag layer covering the wall of the chamber 14.

Because particles below about 10 microns in diameter are almost impossible to retain in large cyclone combustors, one step of the present method involves the removal from the mass of pulverized coal to be used as fuel of the small end of the particle distribution. More specifically, in the present method, coal particles smaller than about 10–20 microns in diameter are removed from the pulverized coal particles. On the other hand, because, in accordance with the invention, it is desired that the final 30 to 50% of coal particle combustion take place on the wall of the chamber 14, particles larger than about 200 microns in diameter are also removed from the pulverized mass.

It has previously been observed that tangential gas velocities at the slag wall of a cyclone combustor in excess of 600 feet per second tend to strip and reentrain liquid slag, a condition at odds with the desired goal of maximizing the retention of slag in the combustor. Accordingly, in accordance with this invention, maximum tangential gas velocities at the slag wall are maintained at between about 100 ft./sec. and 300 ft./sec.

Coal Particle Combustion in Gas Suspension

The particle transit time in the gases within the chamber 14 provides the time frame during which particle heat-up, devolatilization and char gasification take place in the present method. Based upon experimental results in connection with a 1,000,000 BTU/hr. cyclone combustor, it is estimated that for particles between 30 and 200 microns in diameter, time periods of less than 10 milliseconds are available for devolatilization and char burn-up in the gas stream prior to impact of the particles with the slag layer on the wall of the chamber. This period is too short for any significant reactions with the coal prior to wall impact of the particles. On the other hand, in a 150 million BTU/hr. cyclone combustor of the above-described type, using end injection of fuel and air the corresponding times are about 100 milliseconds. Under these conditions, significant devolatilization and char burn-up can take place with the suspended coal particles.

The fuel (and sorbent) particles should be injected in a region where the centrifugal force on the particles by the tangential gas velocity drives the particles toward the wall. Particles greater than 200 microns in diameter will have been recycled to the pulverizers for size reduction to less than 200 microns. For the end injection method performed in the above-described combustor 10, this means that injection should be outside of the radius where the gas flow changes from simple vortex flow (wherein the product of velocity divided by combustor radius is constant), to a regular cyclonic vortex flow (wherein the product of velocity and a fractional exponent of the radius is a constant). This reversal usually occurs at somewhat less than 50% of the combustor's inner radius. In addition, the fine coal particles (i.e. less than 10–20 microns in diameter) should be injected, also at the closed end of the combustor, but through special ports located near the inner cylindrical wall, where the higher temperature from the 2000+° F. wall will aid in achieving rapid ignition as well as increase the probability that the ash released from these fine particles will stick to the slag layer. Injection of the micron size coal fines at this location increases the particle retention capability of the cyclone.

Fireside Injection of Sorbent

Simultaneously with the injection of the air-fuel stream in the above-described manner, a stream of pulverized sorbent material, capable of capturing sulphur compounds released from the coal, is injected into the chamber 14. The sorbent particles, like the coal particles, have a size which is preferably in the range of about 10 to 200 microns in diameter, the lower dimension being dictated by the above mentioned difficulty in retaining very small particles in the combustor 10, and the larger dimension by chemical reaction requirements.

The coal/sorbent particle sizes, their size distribution and their three-dimensional trajectories appear to be primary parameters which affect the performance of the combustor. Higher relative velocities between the particles and the gas result in higher particle heating rates. Also, the mean size of the particles determines the proportioning of the combustion and chemical reactions between the gas phase and the wall.

It has heretofore been observed that sulphur capture by the sorbent material effectively ceases if the sorbent is exposed for long time periods to gas temperatures in excess of about 2000° F. Therefore, the following conditions are established in the cyclone to assure maximum sulphur capture by the sorbent particles, subsequent to their injection and while they are still in suspension in the gas steam:

(a) The gas temperature in the injection region is lower than the average combustion temperature in the cyclone due to the time delay in the release of the combustible volatile matter from the coal, and its subsequent combustion. The solid coal char burns at a much slower rate and its combustion products do not impact the sulphur capture process during the initial sorbent injection and suspension period.

(b) A considerable fraction of the sulphur in the coal is in an organic state, and it is contained mostly in the volatile matter in the coal. Thus, this sulphur is released with the volatile matter near the sorbent injection region, where the local gas conditions are oxidizing. This situation exists even if the *average* stoichiometry of the cyclone is fuel rich, i.e. reducing. Thus, the sulfur compounds released are either $SO_2$ and $SO_3$.

(c) The sorbent (assumed here to be limestone) must first calcine, (i.e. go from $CaCO_3$ to CaO), before it can react with the gaseous sulphur compounds. During this heat absorbing calcination process, the temperature of the limestone particles will be lower than the local gas temperature. Since it is believed that the sulphur capture reaction is controlled by the local particle temperature, it appears that the sulphur capture time period by the sorbent particles can be extended into the region of the cyclone where the gas temperature may be locally higher than the 2000° F. limited generally needed for efficient sulphur capture.

(d) The reaction of the sorbent (e.g. limestone) with the sulphur gas depends on the product of the chemical reactivity of the calcined limestone (i.e. CaO), and the total external and internal particle surface area. During calcination, the internal sorbent surface is known to be more than 10 times greater than fully calcined CaO. (G. Flament, "Direct Sulfur Capture in Flames through the Injection of Sorbent", Inst. Flame Res. Rpt. No. G19/a/9, Nov. 1980, Ijmuiden, Netherlands). Thus the sorbent perferably is injected as uncalcined limestone to increase its reactivity.

By combining all the above factors, it is estimated that over 50% of the sulphur released in the injection zone can be captured by the sorbent particles prior to their impact on the walls of the cyclone. These capture figures apply to a commercially acceptable calcium to sulphur ratio of 3 or less.

Reentrainment of Particles for Additional Combustion

In accordance with the present invention, coal and sorbent particles which impinge upon the slag covered wall of the chamber 14 are caused to be reentrained and redeposited or combusted downstream. Such behavior is similar to what one might encounter in the movement of fine sand by a high velocity wind. Without such reentrainment of the coal, it is calculated that the ability of the char to react on the wall with $O_2$, $CO_2$ and $H_2O$ is limited to about one-third of the char reaching the wall in the 1,000,000 BTU/hr cyclone. Similarly, if the sorbent particles, remain on the wall, their capacity to react with the gaseous sulphur compounds is limited to only a few percent of the gaseous sulphur concentration. A similar limitation on char combustion by char and sulphur capture by the sorbent on the wall is computed for a commercial scale cyclone.

Experimental data suggests that the desired reentrainment can be made to occur in a 1,000,000 BTU/hr. cyclone combustor in a region (Zone V in FIG. 5) lying mainly within one centimeter from the wall. Calculations based upon the work of Bagnold (involving investigation of sand entrainment in a wind tunnel and in field studies), (R. A. Bagnold, "The Movement of Sand Storms", Proc. Roy. Society A, V. 167, p. 282 (1938)), suggest that once deposits of coal and limestone particles reach a thickness of several layers, so that the uppermost layers do not stick to the slag, extensive reentrainment can be made to occur. In the present method, entrained particles are transported downstream within the chamber 14 at velocities on the order of the average axial gas velocity within the chamber 14. For coal and sorbent particles of the sizes involved here, tangential wall velocities of about 70 ft. sec. appear to cause reentrainment. Although reentrainment by the "sandstorm" mechanism may have occurred in some cyclone combustors, it has now been found possible to adjust the relative sizes of the coal and limestone particle distributions in such a way that the coal particles impinge on the slag layer with incomplete pyrolysis and devolatilization. These are completed on the slag layer, after which carbon gasification takes place by the "sandstorm" reentrainment mechanism. This is best accomplished by initial deposition the particles in a well defined band on the combustor wall. The reason for the increased reactivity of the char and sorbent after they have been reentrained by the "sandstorm" mechanism appears to be that the particles are then completely surrounded by the reacting gas species, with their complete external and internal surface areas exposed to the gas species. On the other hand, while the particles are lying on the surface, the gas species can only reach the uppermost particle layers.

Using the "sandstorm" reentrainment mechanism for the case of the 1,000,000 BTU/hr. cyclone, it appears that under normal excess air conditions, the "sandstorm" can reentrain a mass of char in the tangential, transverse gas flow direction, equal to an average of 20 times the char particle deposition rate on the walls of the cyclone. In the axial direction, the corresponding number is several times the char deposition rate. Under reducing conditions, the corresponding figures are several times smaller, but still sufficient to reentrain most of the char. The sorbent particle concentrations are much lower than those of the char. However, the sorbent particle densities and their mean diameter are about twice those of the char. Therefore, the corresponding reentrainment mass flow rates for the sorbent are about the same as for the char. In any case, calculations show that reentrainment affects almost all the particles. They also show that with reentrainment the char burning capacity of the cyclone is at least two to three times that of its wall burning capacity, and the sorbent sulphur capture capacity is in the range of 50% of the sulphur content of the coal, for a calcium to sulphur ratio of 3, which is the maximum commercially acceptable sorbent concentration.

FIG. 7 illustrates somewhat diagammatically, by means of a cross-sectional view of the chamber 14, the build-up and reentrainment and redeposition of coal and sorbent particles.

Referring to FIG. 7, there is seen on the inner wall of the lining 16 of the chamber 14 a slag layer "S", upon which there has impinged a mass of coal and sorbent particles "P". As is shown in the Figure, when the mass of particles "P". becomes several layers thick, the uppermost particles, of which coal particle $P_1$ is an example, no longer adhere to the slag layer "S", and become reentrained in the gas stream "G". Reentrained coal particles, like $P_1$, advance within the chamber 14 in an axial as well as radial direction, as has been explained above, and continue to burn.

Removal of the Sulphur Bearing Sorbent from the Cyclone

The sulfhur captured by the calcined limestone is removed inside the cyclone as a result of the impingement and retention on the liquid slag layer of the reacted limestone particles, specifically, $CaSO_4$, or CaS particles. The latter particles may be formed in the gas state because the average stoichiometry inside the cyclone must be reducing for optimum sulphur and nitrogen oxide control. Under reducing condition in the gas stream, some or all of the $CaSO_3$, or $CaSO_4$ particles present could be converted to CaS. A benefit of this conversion is that CaS is a more stable compound at higher gas temperatures (to about 2700° F.). These particles are either covered by the slag or melt in the slag.

Since the melt can result in the reevolution of the sulphur in gaseous form, it is essential to design the cyclone in such a way that the slag is fluid enough to remove it in a time which is less than the sulphur gas reevolution time from the slag. The sulphur gas reevolution time is estimated to be in excess of 10 minutes, and appears to depend upon the slag temperature, the local gas stoichiometry and the composition of the slag. Rapid removal is accomplished by keeping the slag and sulphur bearing limestone mixture at sufficiently low viscosity (achieved by keeping the cyclone wall temperature in 2000° F. to 25000° F. range), to allow rapid drainage from the cyclone combustor. The slag drainage method is by deposition on the cyclindrical walls, drainage under the influence of gravity down the side walls of the horizontally oriented cyclone, and then drainage along the floor of the cyclone to a drainage tap 20, located in FIG. 2 at the downstream end of the cyclone. To aid in drainage, the floor of the cyclone (shown in FIG. 2), is slanted by several degrees toward the slag tap 20. Since the slag and limestone viscosity will vary with different coals and operating conditions, the preferred operating method is to use air cooling of the ceramic liner in the cyclone. With air cooling one can adjust the ceramic-slag interface temperature to maintain the slag in a completely liquid state, and to keep it as thin as possible (several millimeters in thickness). On the other hand, with water cooling of the cyclone walls one cannot achieve a wide range of part load operating conditions, while simultaneously maintaining the complete liquid state of the slag. Consequently, with water cooling, the slag residence time in the cyclone increases, which results in greater sulphur gas reevolution from the slag.

In summary, then, in the practice of the present method, two independent mechanisms for sulphur capture are used in tandem in a cyclone combustor. One of the mechanisms involves particles of fuel and a sorbent suspended in the gas stream in an injection zone, and the other involves burning particles reentrained in the gas stream by a "sandstorm" effect near the wall of the combustor 10. It appears that each method, independently, is capable of reducing sulphur emissions by 30 to 50%, and that their combined action could very well remove most of the sulphur. The present method, therefore, appears to have the potential for sulphur capture in a commercial scale cyclone combustor with economically feasible Ca/S ratios of about two to three. 70 to 90% sulphur capture at economical Ca/S ratios would facilitate the conversion of existing oil fired boilers to coal at a cost of about one-half that of conventional conversions using stack gas scrubbers.

As an illustration of the practice of this invention, consider by way of example a commercial scale 150,000,000 BTU/hr. cyclone coal combustor. The combustor would operate under reducing stoichiometry, with the air/ coal fuel ratio equal to 50–75% of that required for the stoichiometric combustion of the coal. All the solid and gaseous injection and removal conditions would be as described above. The combustor would have an internal diameter of about 6–7 ft. and an internal length of about 10–14 ft. The internal diameter of its exit nozzle is about 3–4 ft., and it is directly attached to the sidewalls of a conventional furnace section of a boiler.

Under these conditions, the nitrogen compounds locked in the coal would be released as NO, $NH_3$, and HCN inside the cyclone. The average gas temperature inside the cyclone would be about 3000° F., too low to produce any significant thermal NO compounds. After the gas entered the furnace region of the boiler, it would be allowed to cool to the 2000° F. range before the final combustion air is introduced into the furnace to convert the CO and $H_2$ and other unburned compounds to $CO_2$ and $H_2O$. The computed NO emission levels at the stack would be less than 100 parts per million.

Using a limestone injection mass flow rate which results in a calcium to sulphur ratio of 3 or less inside the cyclone, it is calculated that a sorbent with an internal surface area of about 50 square meters per gram of CaO and a reactivity similar to that deduced by Coutant (Coutant, "$SO_2$ Pickup by Limestone and Dolomite Particles in Flue Gas", J.Eng.Power (1970), page 113) will capture 50% of the sulphur in 100 milliseconds, for a CaO particle temperature of 2000° F. This time period is equal to the suspension time after injection into the cyclone of particles in the 30 micron diameter range, prior to their impact on the wall. It is also equal to the average particle transit time by the sandstorm entrainment mechanism along the axial length of the cyclone. Thus each of the two sulphur capture mechanisms, operating independently, can remove about one-half of the sulphur inside the cyclone in the 100 millisecond time period. Their combined action could remove most of the sulphur released by the coal. Finally, at the specified slag viscosities, the reacted sorbent can be removed with the slag in under 10 minutes, to prevent reevolution of the captured sulphur in gaseous form.

The present invention may be embodied in other specific forms without departing from its spirit or essential attributes. Accordingly, reference should be made to the appended claims, rather than the foregoing specification and accompanying drawings for an indication of the scope of the invention.

I claim:

1. A method for the combustion of coal in a slagging cyclone combustor while minimizing the emission of ash particles and other pollutants, comprising the steps of: pulverizing a quantity of coal; removing from the pulverized coal particles too large to readily be burned in the combustor; injecting the remaining pulverized coal particles into the combustor adjacent to a closed end wall of the combustor together with a stream of primary combustion air so as to form an air-fuel stream; injecting into the combustor adjacent to the closed end wall a stream of secondary air in such a manner as to cause said air-fuel stream to flow helically within the combustor; maintaining the velocity of said secondary air stream such that centrifugal force on said coal particles due to tangential gas velocity drives said particles toward the cylindrical wall of the combustor so that combustion of said coal particles is apportioned between and occurs both in the gas stream and on the walls of the combustor with most of said combustion occurring in the gas stream; injecting into the combustor adjacent to the location at which the fuel-air stream is injected a pulverized sorbent capable of capturing sulphur compounds, whereby the sorbent being injected into a region within the combustor in which the local gas conditions are oxidizing and the temperature is lower than the average temperature of the combustor, the average stoichiometry of said combustor being reducing; maintaining a liquid slag layer on the cylindrical wall of the combustor, the sulphur captured by the sorbent being removed from the cyclone as a result of the impingement and retention thereof on the slag layer, and the further steps of controlling by air cooling the temperature of the slag layer, and removing slag from the combustor in a time less than the time required for evolution of sulphur gas from the slag.

2. A method in accordance with claim 1, wherein said air-fuel sstream is injected in an annular configuration, spaced from the central axis of the combustor, and the secondary air stream is injected betwen said air-fuel stream and the cylindrical wall of the combustor.

3. A method in accordance with claim 1, wherein said secondary air is regenereatively preheated by heat exchange from the combustor.

4. A method in accordance with claim 1, wherein the combustor is operated at overall fuel rich conditions of approximately 50 to 70 percent of stoichiometric conditions, so as to reduce $NO_x$ emissions.

5. A method in accordance with claim 1, and the further step of injecting into the combustor coal particles smaller than about 10–20 microns, said air-fuel stream, said secondary air stream and said coal particles smaller than about 10–20 microns being injected into the combustor through a closed end wall thereof and near the cylindrical wall of the combustor.

6. A method in accordance with claim 1, and the further step of maintaining the tangential and axial velocities of the gases in the combustor such that unburned coal particles deposited on slag-covered walls of the combustor are reentrained, so that combustion of said particles continues.

7. A method in accordance with claim 1, wherein substantially all of said coal is burned in a region adjacent to the walls of the combustor.

8. A method in accordance with claim 1, wherein the temperature of the sorbent while the sorbent is in the sorbent-carrying air stream is less than 2000° F., said sorbent being a compound of a group comprising limestone, dolomite and calcium hydroxide, sulphur capture proceeding in said region by the steps of calcination of the sorbent and combination of the calcined sorbent particles with compounds of sulphur.

9. A method in accordance with claim 8, wherein the sorbent particles are in suspension in said oxidizing region for less than about 0.1 seconds, sulphur capture taking place within said oxidizing region and said time.

10. A method in accordance with claim 1, and the further steps of maintaining the tangential and axial velocities of the gases in the combustor such that sorbent particles and unburned coal particles deposited on slag-covered walls of the combustor are reentrained so that combustion of coal particles continues, and sulphur capture also continues under oxidizing or reducing gas conditions until the temperatures of the sorbent particles exceeds about 2000° F.

11. A method for the combustion of coal in a slagging cyclone combustor while minimizing the emission of ash particles and other pollutants, comprising the steps of: pulverizing a quantity of coal; removing from the pulverized coal particles too fine to be retained in the combustor and too large to readily be burned in the combustor; injecting the remaining pulverized coal into the combustor adjacent to a closed end wall of the combustor together with a stream of preimary combustion air to form an air-fuel steam; injecting into the combustor adjacent to the closed end wall a stream of secondary air in such a manner as to cause said air fuel stream to flow helically within the combustor with said secondary air stream surrounding said air-fuel stream so that centrifugal force on said coal particles drives said particles toward the cylindrical wall of the combustor; maintaining the velocity of said air-fuel stream such that gasification of the coal particles is apportioned between and occurs both in the gas stream and on the walls of the combustion chamber; gasifying most of the injected coal while the coal is suspended in the gas stream, said step of gasifying in the gas stream being performed under fuel rich conditions of about 50 to 70% stoichiometric conditions; and gasifying substantially all of the remainder of the coal on the wall of the combustor so that the ash is retained in slag on the wall of the combustor; and the further step of removing the slag from the combustor, said step of removing being performed in a time less than the time required for the reevolution of sulphur gas from the slag.

12. A method in accordance with claim 11, and the further steps of maintaining the tangential and axial velocities of the gases in the combustor such that unburned particles deposited on slag-covered walls of the combustor are reentrained in the gases, so that combustion of said particles continues.

13. A method in accordance with claim 11, wherein a slag layer is maintained on the cylindrical wall of the combustor, and the temperature of the slag layer is controlled by air cooling said cylindrical wall.

14. A method in accordance with claim 11, and the further steps of injecting into the combustor adjacent to the air-fuel stream a pulverized sorbent, the temperature of the sorbent while the sorbent is in the sorbent-carrying air stream being less than 2000° F., said sorbent being a compound of a group comprising limestone, dolomite and calcium hydroxide, sulphur capture proceeding in said region by the steps of calcination of the sorbent and combination of the calcined sorbent particles with compounds of sulphur, and a slag layer being maintained on the walls of the combustor, the sulphur gas captured by the calcined sorbent being removed from the cyclone as a result of the impingement and retention thereof on the liquid slag layer.

* * * * *